United States Patent [19]

Kircher

[11] 4,367,134

[45] Jan. 4, 1983

[54] METHOD FOR ASSEMBLING MEMBRANE ELECTROLYTIC CELLS

[75] Inventor: Morton S. Kircher, Clearwater, Fla.

[73] Assignee: Olin Corporation, New Haven, Conn.

[21] Appl. No.: 230,230

[22] Filed: Feb. 2, 1981

Related U.S. Application Data

[63] Continuation-in-part of Ser. No. 142,204, Apr. 21, 1980, Pat. No. 4,311,577, which is a continuation-in-part of Ser. No. 128,684, Mar. 10, 1980, abandoned.

[51] Int. Cl.[3] ..... C25B 9/00; B01D 25/26

[52] U.S. Cl. ..... 204/253; 204/257; 210/230

[58] Field of Search ..... 204/253, 257, 258, 252, 204/263–266, 254–256, 296; 210/230

[56] References Cited

U.S. PATENT DOCUMENTS

| | | | |
|---|---|---|---|
| 4,000,057 | 12/1976 | Mrazek et al. | 204/296 |
| 4,032,423 | 6/1977 | Cunningham | 204/256 X |
| 4,056,458 | 11/1977 | Pohto et al. | 204/263 |
| 4,124,477 | 11/1978 | Tokawa et al. | 204/296 X |
| 4,153,532 | 7/1979 | Fitch et al. | 204/267 |
| 4,175,025 | 11/1979 | Creamer et al. | 204/253 |

FOREIGN PATENT DOCUMENTS

| | | | |
|---|---|---|---|
| 578896 | 7/1959 | Canada | 204/253 |
| 53-64697 | 6/1978 | Japan | 204/253 |
| 54-151595 | 11/1979 | Japan | 204/253 |

*Primary Examiner*—Donald R. Valentine

*Attorney, Agent, or Firm*—Ralph D'Alessandro; Donald F. Clements; Thomas P. O'Day

[57] ABSTRACT

A method of assembling an electrolytic membrane cell is disclosed. The method includes the steps of conditioning the membranes with a conditioning fluid, assembling a vertical stack of horizontal electrode frames with a horizontal membrane sheet between each pair of frames, applying pressure to vertically compress the vertical stack, rotating the compressed vertical stack from a vertical orientation through approximately 90° in which orientation of the stack is called a "pack", connecting the pack into an electrical circuit and to raw material supply lines and product withdrawal lines and then electrically operating the pack while maintaining the pack in a horizontal orientation.

19 Claims, 6 Drawing Figures

METHOD FOR ASSEMBLING MEMBRANE ELECTROLYTIC CELLS

This application is a continuation-in-part of application Ser. No. 142,204, filed Apr. 21, 1980, now U.S. Pat. No. 4,311,577 which is a continuation-in-part of application Ser. No. 128,684, filed Mar. 10, 1980, now abandoned.

BACKGROUND OF THE INVENTION

This invention relates to a method of assembling electrolytic cells and particularly to a method for assembling membrane-type electrolytic cells.

Electrolytic cells have been developed which are based on the design principles used in the unit operation of "filter presses" used to filter solids from liquids. These "filter press" cells have followed the practice originated with filter presses of assembling plates or frames housing electrodes with intermediate membranes into a "bank" of frames supported with the frames in a vertical plane on a filter press skeleton structure. In general, this is a convenient method of assembling since the frames may be stored in place and may be shifted back and forth as the cell is assembled or dismantled. In the filtration field, presses are commercially available that shift frames automatically according to a program. Such presses are generally used with filter press electrolytic cells in order to simplify repairs by providing easier access to individual membranes and electrodes in the cell bank. This technique of using a long cell bank and a shifting press has several disadvantages. In particular, it is difficult to hold a membrane which may be wet, slippery, heavy, fragile and soaked with caustic soda, while trying to simultaneously hold the electrode frames in a spaced position to provide enough space between the electrode for fitting the membrane between the two spaced vertical frames and between any cross-frames or other device used to space the frames to obtain a satisfactory seal or fit. The membranes, which are very expensive compared to conventional diaphragms, may tear or "bag" out of shape or even fail to seal on all gasket surfaces. Furthermore, it is extremely awkward and difficult to manipulate large, high electrode frames in such a filter press apparatus and, therefore, the height of the cell is limited by practical considerations in order to allow operators to observe and repair minor gasket or membrane irregularities on many parts of the frame circumference, e.g. top, bottom, and high sides. Although such a height limitation has been conventionally imposed upon filter press cell designs, it would be desirable and advantageous, if possible, to develop a much higher cell in order to increase the amount of product which can be produced using a given amount of floor space in the plant in which the cell is contained.

It has also been found that treating or conditioning the membranes is essential if the electrolytic cell is to operate at optimal efficiency after assembly. Generally, the membranes are received in a nonionic state and must be converted to an ionic conductive form. Additionally, failure to treat or condition the membrane prior to cell assembly will cause excessive swelling or shrinkage of the membrane after the membranes are emplaced within the cell and operation of the cell begun. Excessive swelling causes wrinkling in the membrane after cell assembly. This wrinkling creates a crease that generally bears against the anode and is attacked by chlorine.

Apparently the crease from the wrinkle becomes hardened and splits along its top. Alternately, where excessive shrinkage occurs, cracking or rupturing in the membrane will occur. Either of these two situations where there is a physical break in the surface of the membrane causes the cell to dramatically drop in operating efficiency because the caustic solution within the anode is permitted to flow into the anolyte. The quantity of chlorine gas produced also decreases while current consumption dramatically increases. Additionally, chlorate levels increase in the anolyte and catholyte fluids.

A solution to these and other problems is achieved with the present invention by providing a method of assembling a monopolar filter press-type electrolytic cell by treating or conditioning the membranes, assembling a vertical stack or horizontal electrode frames with a horizontal membrane sheet between each pair of opposed frames, applying pressure to the opposite vertical ends of said stack to vertically compress the stack, rotating the compressed vertical stack from a vertical orientation through approximately 90° and connecting and operating the assembled cell in an electrolytic circuit.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION

Figures 1, 2, 3, 4:
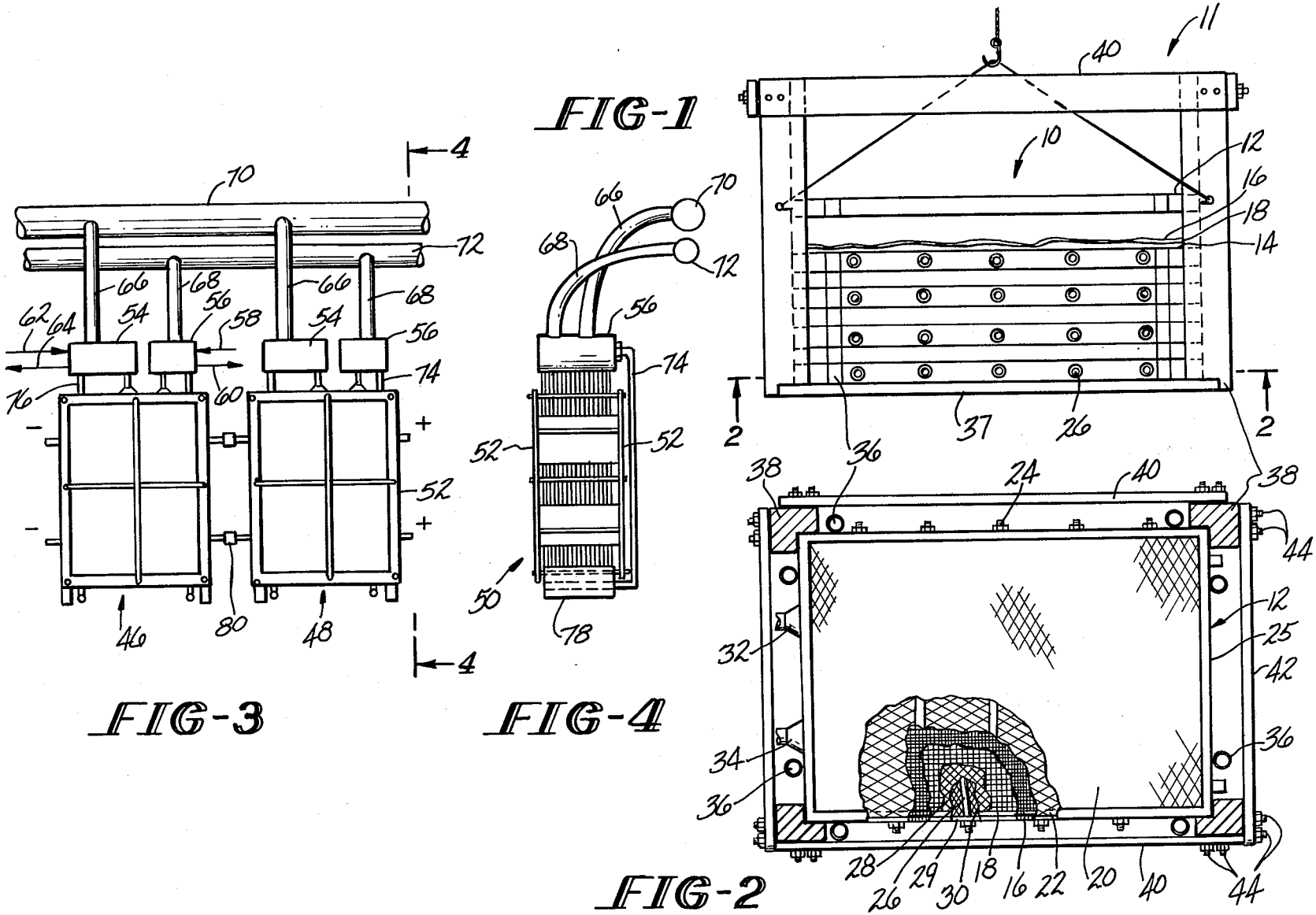
FIG. 1 is a side, elevational view of a partially assembled stack of electrode frames during the practice of the method of the invention.
FIG. 2 is a bottom, cross-sectional view taken along line 2—2 of FIG. 1 illustrating the layering of the stack of FIG. 1.
FIG. 3 is a front, elevational view of the stack of FIGS. 1 and 2 after the stack has been rotated to a horizontal position and connected in a series cell circuit.
FIG. 4 is a side, elevational view of the cell circuit of FIG. 3 taken along line 4—4 of FIG. 3.

FIG. 1 is a side, elevational view showing a stack 10 of anode frames 12 and cathode frames 14 with a spacer 16 and membrane 18 located between each opposite pair of anode and cathode frames 12, 14. FIG. 1 also shows an optional jig 11 which can be used for purposes of guiding and holding stack 10 during assembly according to the method of the invention. Other guiding and support structures such as, for example, the preferred assembly area of FIGS. 5–6 could be utilized so long as it is still possible to properly align frames 12,14 in stack 10 during assembly. Jig 11 is shown to be connected temporarily to an endplate 37 upon which stack 10 rests. During their assembly in stack 10, frames 12 and 14 are maintained in a horizontal or substantially horizontal plane in order to allow their weight to assist in compressing the stack 10 and thereby tend to hold spacers 16 and membranes 18 in position, as well. Jig 11 comprises four vertical columns 38, two long cross members 40 and two short cross members 42. Cross members 40 and 42 attach to column 38 by pairs of bolts 44 (see FIG.

2). FIG. 2 also shows the same stack of frames held by columns 38 and cross members 40 and 42. The same reference numbers in FIGS. 1–4 refer to the same parts, unless otherwise indicated. Each frame 12 or 14 has external lifting eyes 36 which, when the frame is assembled in stack 10, are used to lift the frame. Eyes 36 are adapted to receive lifting hooks (not shown). Although eight eyes 36 are shown attached to each frame in FIGS. 1 and 2, any number of eyes could be utilized if desired. Eight eyes are preferred because this number allows a hook to be located at the end of each side of frames 12 and 14 so as to minimize the amount of unsupported frame during lifting and to avoid interference of the guides with bus bars of monopolar cell frame necessary to connect the connector rods to a current source for electrolysis to occur.

Each frame 12 also includes a pair of spaced, planar foraminous mesh surfaces 20 and 22 between which lie a plurality of substantially horizontal conductor rods 24. Similarly, each frame 14 includes a pair of spaced, planar foraminous surfaces 28 and 30 between which lies a plurality of substantially horizontal conductor rods 26. As best seen in FIG. 2, each frame 12 includes a solid outer border portion 25 and each frame 14 includes a frame-like outer border portion 29. Border portions 25 and 29 support and space the mesh surfaces 22, 24, 28, and 30 while rods 24 and 26 conduct electricity from the outside of the cell to mesh surfaces 20,22 and 28,30, respectively. Each frame 12 is provided with an outlet pipe 34 while each frame 14 is provided with an outlet pipe 32. In the case where frames 12 are anodes and frames 14 are cathodes, pipe 32 would serve as a hydrogen gas outlet while pipe 34 would serve as a chlorine gas outlet. Pipes 32 and 34 connect respectively, to disengagers 56 and 54 (see FIGS. 3 and 4).

The stack 10 shown in FIGS. 1 and 2 is termed a monopolar stack since each frame has a single polarity. If desired, stack 10 could be made in a bipolar configuration in which each frame should have one anode side and one cathode side electrically connected to each other. If each stack 10 was made of bipolar frames, conductor rods 24 and 26 would not be present since bipolar electrode frames conventionally have internal conductors from anode surface to cathode surface.

The stacking operation could be accomplished through use of overhead cranes and slings which could be remotely controlled to lift and move and position the frames into and out of jig 11 during assembly or disassembly. Membranes 18 could be conveniently stored in a flat, plastic-lined box filled with hydrolyzing liquid so that they could be readily moved atop the frames during the stacking operation. Frames 12, 14 and spacers 16 could be conveniently stored in a cabinet 118.

Figure 6:
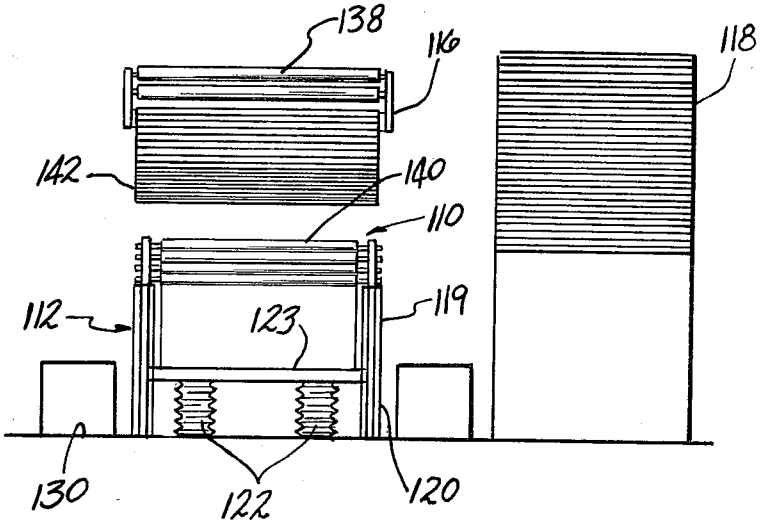
FIG. 6 is an elevational view of the assembly area of FIG. 5 taken along line 6—6 of FIG. 5.
Figure 5:
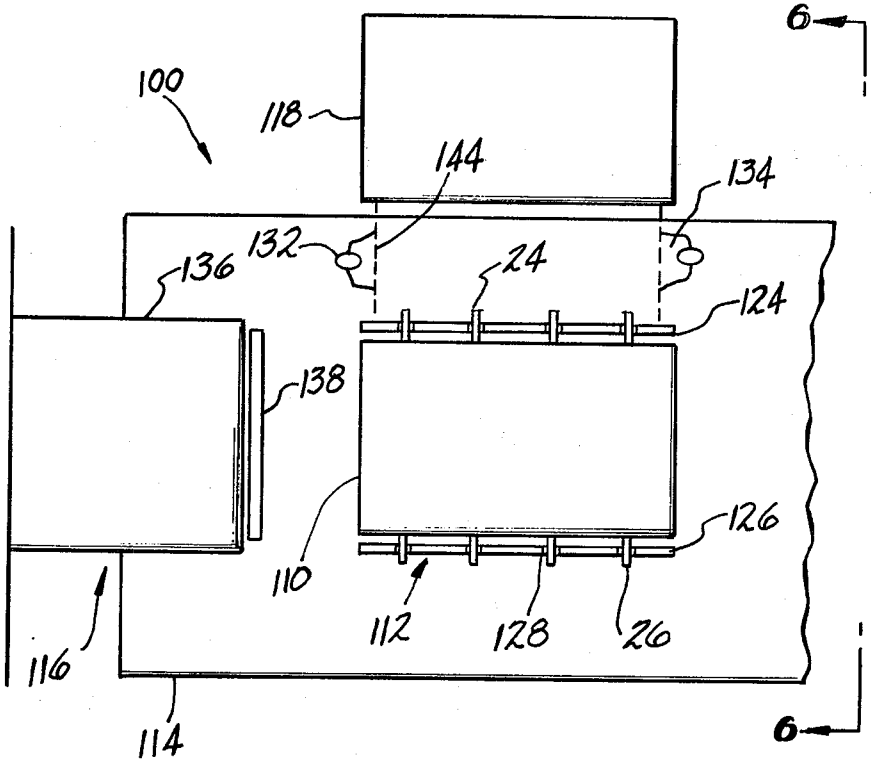
FIG. 5 is a top planar view of a cell assembly area adapted for vertical assembly according to the invention.

A preferred method of assembly is to eliminate jig 11 and to instead use a spirit level ("carpenter's level") to vertically align each frame as it is lowered and seated on the frames below. FIGS. 5 and 6 show an assembly area 100 designed for use in efficiently vertically stacking a pack 110 of frames preparatory to compression and use in the cell 46,48 as previously described. Reference will be made below to membranes 18 and spacers 16 and other items shown in FIGS. 1–4.

Area 110 comprises a stack support framework 112, an elevated work platform 114, a membrane storage box 116, a frame storage cabinet 118, and a spacer storage cabinet 142 which is attached to box 116 and thus placed adjacent a side of framework 112. Stack 110 of FIGS. 5–6 is similar to stack 10 of FIGS. 1–2 except that it is free-standing so as to avoid the need to lift membranes 18 over a jig 11, since membranes 18 could be damaged during such lifting unless proper care was taken. With a free-standing stack 110, the membranes 18 and spacers 16 (see FIGS. 1–2) can be slid laterally directly onto the top of stack 110 without lifting.

Framework 112 comprises a U-shaped guide rack 119, a rack holder 120 and four or more air cylinders 122. U-shaped rack 119 has a bottom portion and two recessed vertical member 124, 126 each having recess 128 adapted to align and restrain the outer ends of rods 24 and 26. Air cylinders 122 are connected to a floor 130 upon which the assembly area is constructed and to the bottom portion 123 and are used to raise or lower rack 119 so as to position the top of stack 110 at the best levels for the addition of each membrane spacer and frame. Air cylinders 122 are preferably remotely controlled by assembly workers 132, 134 as they assemble stack 110. A conventional remote control system could be used for this purpose.

Membrane storage box 116 is supported from a building wall (not shown) adjacent area 100, but could be supported in any other desired fashion which would not interfere with the assembly procedure. Box 116 comprises a conditioning tank 136 and a pair of "squeegies" or wipers 138. The conditioning box 116 can serve multiple purposes. Where a hydrolyzing fluid is utilized, the box will serve to hydrolyze the membrane (i.e. converting a salt from the ion exchange group to the active acid form) so that the membranes are in their ion conductive form. The conditioning box also can serve to contain a fluid that, either separately or concurrently with the hydrolysis, equilibrates the membranes with the solution in the box so that the solution pressure of the water molecules on the membrane is at the desired level when the membranes are assembled in the cell. This is achieved by leaving the membranes in the conditioning solution sufficiently long so that the water vapor pressure of the solution is in equilibrium with the water vapor pressure of the membranes. The net result of this process is that the membranes, when placed in the cell, do not absorb water in the cell and swell or have too much water so that the water is given off and the membrane shrinks. Should the membranes absorb water within the cell during operation, the membranes will swell and cause the aforementioned wrinkles to occur. Conversely, should the membranes have excessive water, the water will be given off during operation in the cell and the membranes will shrink, creating the problem of cracking or rupturing of the membranes. The conditioning box 116 also serves the purpose of storing the membranes in their hydrolyzed and/or equilibrated states until they are used during the stacking procedure.

It is preferred that the membranes be prepositioned in box 116 prior to the actual assembly operation so that the membranes can most rapidly be removed from the box 116 onto the top 140 of stack 110 during assembly. In order to more easily handle membranes 116 during the actual assembly, it is preferable to fabricate the membranes ahead of time with a loop in one end through which a rigid rod can be passed, the rod being used as a handle during the sliding of the membranes from box 116 onto stack 110. The membranes could easily be transferred directly from a shipping box into box 116 if the membrane was precut into sheets of proper size.

The procedure for moving the membranes from box 116 onto stack 110 will now be described. First, the top 140 of stack 110 is adjusted by use of air cylinders 122 so that top 140 is at the level of the particular membrane which is to be slid from box 116 onto stack 110. An operator then grabs the rod which has been passed through loops in one end of the membrane as described above, and then pulls the membrane from box 116 laterally directly onto the top 140 of stack 110. In this way, the stresses on the membrane during assembly are minimized. Box 116 is elevated so that stack 110 will not have moved a great deal and so that box 116 is at a convenient level for the operator 132, 134. The squeegies 138 are provided to remove the hydrolyzing or conditioning liquid from the membranes as they are withdrawn from box 116.

Cabinet 118 is also elevated at a convenient level for operators 132, 134. Cabinet 118 is provided with a shelf for each frame of the cell to be constructed. The frames are stored in cabinet 118 until needed for the assembly operation. At some time prior to the assembly operation, cabinet 118 is inspected to see that the frames are in proper position for the stacking operation. It will be appreciated that the frames will be inserted into and stored within cabinet 118 with their conductor rods pointing in the appropriate direction so that there is no nedd to rotate or flip the frames during the stacking operation. For purposes of illustration, FIG. 5 shows operators 132 and 134 in position for sliding frames from cabinet 118 onto the top 140 of stack 110. Lines 144 show the position of one of the frames as removed from cabinet 118 just before it is placed atop stack 110.

Platform 114 is a conventional elevated work floor of any suitable material. Platform 114 is elevated in order that the stack 110 can be lowered to a position below the level of operators 132 and 134 and so that air cylinders 122 can be provided underneath rack 119 without raising rack 119 to an awkwardly high position.

Although FIGS. 5 and 6 show operators 132 and 134 manipulating frames, it is understood that the frames could also be handled by a bridge crane, a sling, a hoist, a fork lift, or some other handling device, such as for example, slide bars extendable from cabinet 118, if the sizes of the frames were or the frames were heavy enough to make it undersirable to move them manually. In this regard, it is emphasized that this vertical stacking assembly is designed for use with a membrane-type electrolytic cell which is rather high in comparison with conventional "filter press" cells. Special cell designs are under development which should allow the construction of frames of sufficient size that manual operation might become undesirable.

In order to prevent wrinkling or binding of the membranes or spacers during stacking and during lateral alignment of the frames in stack 110, a vibrator could be used to jiggle the membranes and sheets sufficiently to make them lie flat after such alignment operations. Also, a carpenter's level (not shown) would be used to vertically align the frames during stacking and to check the top 140 of the stack 110 to be sure that top 140 is horizontal to confirm that the frames are properly seated on their gaskets so that the cell will be properly sealed when it is later compressed.

The stack 110 is preferably "preconditioned" following completion of the stacking operation by passing warm, moist air through the frames in order to put the frames at operating temperature. This "preconditioning" is desirable so that there is a minimum of dimensional change from the time stacking is compressed to the time that the cell is at operating condition during normal operation of the cell. If the cell is not preconditioned, larger forces are required to compress the cell, heavier frame construction is needed and the greater forces may tend to damage the gaskets. Preconditioning softens the gaskets. Preferably, the tie bolts which compress stack 110 following vertical assembly would be tightened by application of limited torque in order to put the stack at a predetermined dimension which has been previously calculated to provide adequate seating but yet not compress the gaskets so much that they are damaged.

The membranes which are preferred for use in stack 110 are ion exchange membranes having sulfonic acid or carboxylic acid or moieties as the active ion exchange group. Such membranes are commercially available under the trademark Nafion from E. I. duPont De Nemours and Company or alternatively are available under the trademark Flemion from Asahi Glass Co. Ltd. The anode frames 12 are preferably made of titanium with the mesh surfaces 20,22 being coated with a catalytic anode coating such as a mixed crystal of ruthinium oxide or titanium oxide. Other anode materials could also be used. The cathode frames 14 are preferably made of nickel with a catalytic coating such as Raney nickel layer or some other catalytic coating. Frames 12 and 14 could be built of nonmetallic materials so long as the mesh surfaces 20, 22, 28, and 30 are made of conductive materials suitable for use as electrode surfaces. Platform 114 can be built of wood, iron, or any other desired material. Air cylinders 122 would be of conventional design and would be provided with a conventional remote control so that operators 132, 134 could remotely operate air cylinders 122 during stacking. Box 116 and cabinet 118 could be made of steel, plastic or any other suitable material; however, a chlorine resistant material would be preferred since it is expected that these structures will be exposed to the environment of a chlor-alkali plant which necessarily produces highly corrosive products.

With the above procedural description in mind and the above described apparatus in mind, a number of advantages are obtained which are worthy of additional discussion. The cell which is vertically stacked, rotated, through approximately 90° and then connected can be much larger than conventional cells and yet can be easily inspected for integrity of gaskets and cells because all sides of the frame are readily visible during assembly by merely having an operator work around the perimeter of the vertical stack 110 and check the gaskets on the top 140 of the stack 110. The procedure is also very rapid because box 116 and cabinet 118 can be positioned at a proper height to allow rapid sliding of the various layers of stack 110 onto one another.

The economics of this assembly operation are significant because in a plant of a given number "x" cells it is economical to spend x dollars on the cell assembly area to achieve only a resultant one dollar cost reduction in the construction of each cell. Also, where each one of x cells is replaced y times in a given time period it is economical to spend xy dollars on the assembly area to achieve a one dollar reduction in assembly operation costs during each replacement operation during such time period. Conversely, small expenditures on removing cell assembly techniques can often result in larger reductions in the cost of operating a commercial cell plant. Furthermore, since the cell's production is often lost during the replacement or reconditioning procedure (i.e. the time during which the vertical stacking occurs) large expenditures for assembly equipment may be justified in order to obtain a small reduction of cell "down time" during each replacement or reconditioning operation. In a large plant, these economics might well warrant expensive automatic assembly devices to replace workers 132,134 in order to speed up the procedure and eliminate operator errors.

Once stack 10 is fully positioned, it can be tightened by the use of long bolts such as shown in FIG. 4 which pass through guide holes in frames 52. Other guiding means and other bolt means could also be used such as, for example, flanges on each frame 12 and 14 which cooperate to individually interconnect each frame with the adjacent frames through suitable insulating means. Once the assembled stack has been bolted together, it is compressed by further tightening the bolts to some desired pressure and then the stack 10 is manipulated by a lifting device such as an overhead crane, fork lift, or other similar device and rotated from a vertical stack to a horizontal position. In this new "pack" position, electrodes are vertical and the stack is a horizontal "pack" such as in FIGS. 3 and 4. Prior to actual operation of stack 10 as an electrolytic cell, it is necessary to connect rods 24 and 26 to terminals or bus bars or intercell connectors, so that current can be passed from cell to cell in an electrical circuit of such cells. Before operation of the cell, it is also necessary to connect stack 10 to product supply and withdrawal conduits so that raw materials can be fed to the cell and products can be removed from the cell. In particular, this requires connection of each frame 12 and 14 to a source of raw materials and a product withdrawal line.

FIG. 3 shows a pair of cells 46 and 48, each of each includes a stack 10 (see FIGS. 1 and 2) of electrode frames which have been vertically stacked and then rotated 90 degrees to become a horizontal stack of vertical frames and which has been connected electrically and fluidly so that it can operate as an electrolytic cell. Each cell 46 and 48 is provided with an anode terminal on the right and a cathode terminal on the left. Intercell connectors 80 serve to electrically connect the cathode terminal of cell 48 with the anode terminal of cell 46 so that cells 46 and 48 form an electrical series. It will be understood that any number of cells similar to cells 46 and 48 could be included within this electrical series circuit but that only two cells are shown for simplicity. Each cell 46 and 48 is provided with an anolyte disengager 54 and a catholyte disengager 56; although if frames 12 and 14 were sufficiently thick for disengagement to occur therewith, the disengagers could be omitted. Disengagers 54 and 56 serve to separate or "disengage" hydrogen gas and chlorine gas from caustic catholyte and anolyte brine, respectively. The disengaged hydrogen passes from disengager 56 upwardly through an outlet line 68 to hydrogen-removal line 72 while disengaged chlorine passes upwardly through an outlet line 66 to a chlorine-removal line 70. Disengager 54 receives fresh anolyte through line 62 and depleted anolyte is removed from disengager 54 through line 64. Referring to FIGS. 1–4, gas-containing anolyte is produced within frames 12 and flows from frames 12 to disengager 54 through pipes 34 while disengaged anolyte is recirculated, if desired, down through a downpipe 76 to the bottom of frames 12 so as to increase the upward flow rate of anolyte through frames 12. Similarly, gas-containing catholyte is produced within frames 14 during electrolysis and is fed through pipes 32 upwardly to disengagers 56 while disengaged liquid catholyte is recirculated, if desired, downwardly through a downpipe 74 to the bottom of frames 14 so as to increase the upward flow rate of catholyte through frames 14 during electrolysis.

During assembly of stack 10, an end frame 52 can be placed under stack 10 preceding vertical stacking. If frames 52 are placed under stack 10 during assembly, then end plate 37 of FIGS. 1–2 and end frame 52 of FIGS. 3–4 are the same item. End plates 37 could alternatively be a pan-type end electrode frame in addition to frames 52 and would be extra support for the cell.

If desired, a vibrator could be utilized to assist in the vertical assembly of the stack by causing a vibration of the frames such that the membranes and spacers are better seated. Also, the vibrations tend to smooth out any wrinkles in the membrane during stacking.

The method of the invention is particularly useful for cells having large frames. By "large" frames is meant frames having dimensions in the plane of the electrode greater than about 4 feet. The method of the invention is also particularly useful for cells in which the thickness of the horizontal stack does not exceed about twice the height of the cell. The large frames and limited thickness to height ratio are particularly desirable economically in order to minimize the amount of conductive material which is needed and to maximize the amount of useful part per unit area of producer space of any cell plant utilizing the invention. The number of frames which may be stacked is within the range from about 2 up to about 50 and preferably within the range of from about 5 up to about 40 and more preferably within the range of from about 10 up to about 30 frames. The method may be used for bipolar cells as well as for monopolar cells. The size of the frame which may be used depends more on the requirement of other limitations of cell design than with limitations of the present method. Bipolar cells, through the use of the method of the invention, can be designed practicably for sizes from about 2 feet up to about 30 feet in the horizontal direction transverse to current flow, and from about 2 feet to up to about 15 feet in the vertical direction transverse to current flow. However, the lesser length is an advantage rather than a disadvantage because it eliminates the need for filter presses to manipulate individual frames since the cell length is made sufficiently small through use of the present invention to enable the cells to be removed from the circuit by use of jumper switches of economical size without disrupting current flow through the remaining cells.

Monopolar cells of extremely large size would also be practical within the same ranges with the added limitation that one direction must be limited to about 10 feet maximum because of the economic limitations upon the length of current conductors such as conductor rods 24 and 26. The size of frames given in the Example below, approximately 5 feet by 7 feet, are convenient and comparatively large in comparison with current technology; however, as is indicated above, the present invention makes larger sizes practical.

Prior to application of pressure to the vertical stack, the frames and membranes can be advantageously preconditioned by passing warm moist fluid, such as air, through the frames for a preset time so as to stabilize the frames at operating temperature. When the frames are stabilized at operating temperature then the pressure can be applied to compress the stack the desired amount. Also the membranes may need to be held at a controlled humidity, once they have been hydrolyzed, in order to prevent irreparable damage, although the vertical assembly method is preferably fast enough that drying can be avoided.

Additionally, it should be noted that different solutions can be employed to hydrolyze and condition the membranes. For instance, it may be desirable with certain permselective membranes to utilize a dilute caustic solution in the range of 1 to 2% concentration at a predetermined temperature for a period as long as 16 to 24 hours prior to assembling the membranes in the cell. With other membranes, it may be more appropriate to utilize a more concentrated caustic solution, such as 25% concentration and to leave the membranes in the solution for up to 16 hours at a predetermined temperature. For other membranes it may be desirable to condition and hydrolyze in a 1% brine solution or in a deionized water solution. Whichever hydrolyzing and/or conditioning solution is utilized to condition the membrane, it is to be understood that the most appropriate solution to be employed must be determined based upon the type of membrane and the operating characteristics of the cell. Regardless of the type of solution employed, if utilized within the method of assembly of the instant invention, it will be insured that swelling or shrinkage of the membranes, as appropriate to the particular membrane, will occur during the conditioning steps and prior to insertion into the cell so that such swelling or shrinkage will not occur during operation. The operation of the cell, thus, will not be detrimentally affected.

The method of the invention will be better understood by reference to the following Example which is included for purposes of illustration:

EXAMPLE

A cell having 70 square meters of electrode surface with a rated capacity of 150 KA was assembled using a vertical stacking method. Electrode frames with gaskets cemented in place were laid horizontal and vertically stacked in a pile, in inverse order of assembly. Each frame was approximately 80″×60″×2″. There were twelve anode frames, eleven cathode frames, and two end cathode frames which had cathode mesh surface on one side and a fluid tight surface on the other. On the adjacent side of the rectangular space defining the work area, a flat plastic lined box was laid containing ion exchange membranes, hydrolyzed, and wet with hydrolyzing liquid. The box contained twenty-four membranes approximately 80″×60″. A structural end frame (80″×60″) constructed of 6″ steel channels having 10 projecting lugs for anchoring tie rods was leveled on a platform at the center of the work area. The stack was built in the order: end cathode, membrane, anode, membrane, cathode, membrane . . . etc. to the final end cathode and second structural end frame. As each electrode frame was placed, it was inspected and guided into position using a 5 foot spirit level (to maintain the stack vertical and the frame edges in line). As each membrane was laid in position, it was smoothed flat and adjusted to extend evenly over the gaskets. Tie rods with threaded ends were inserted between the end frames and nuts tightened on the rods by hand. Four guide frames simply constructed of 2″ angle iron were fitted, two on each side of the stack, to guide the "collars" on the current conductor rods. These guides permitted the stack to be compressed, but prevented any substantial movement of any individual frame in the horizontal plane. Nuts were then tightened, in proper, repetitive sequence until the stack was tightened to proper dimensions. The approximate height of the stack including end frames is 66″. By the use of two hoists, the stack was lifted and rotated into its operating position where the stack was 80″ tall, 60″ wide and 66″ long (including frames). Current conductors were installed and the cell was transferred to the cell room for start up. Operation and subsequent inspection indicated that the gaskets had all been sealed and that all membranes had been satisfactorily placed. The time for stack assembly was approximately two hours.

What is claimed is:

1. A method of assembling a monopolar filter press-type electrolytic cell having a plurality of generally planar electrodes appropriately mounted to electrode frames with ion-selective permeable membrane sheets interposed between each adjacent pair of electrodes, the assembly being accomplished at a single work area, which comprises the steps of:

(a) placing a first end frame on a generally horizontal supporting structure;

(b) treating the membrane sheets with a hydrolyzing fluid;

(c) placing a first cathode frame on top of said said first end frame, said first cathode frame being oriented generally horizontally;

(d) placing a first of said membrane sheets on top of said generally horizontally oriented cathode frame, said first membrane sheet being oriented generally horizontally thereacross;

(e) placing a first anode frame on top of said said first membrane sheet, said first anode frame being oriented generally horizontally;

(f) placing a second membrane sheet on top of said first anode frame, said second membrane sheet being oriented generally horizontally thereacross;

(g) placing a second cathode frame on top of said second membrane sheet, said second cathode frame being oriented generally horizontally thereon;

(h) repeating steps d-g a predetermined number of times until the desired number of anode and cathode frames are stacked in a generally vertical stack on top of the generally horizontal supporting structure;

(i) placing a second end frame on top of said generally vertical stack of frames;

(j) vertically compressing said generally vertical stack of frames by the application of uniform pressure to the first and second end frames so that substantially no horizontal movement of the electrode frames results as the frames are compressed together into a compressed state;

(k) securing retainers to said generally vertical stack of frames to retain said generally vertical stack of frames in said compressed state; and (l) rotating said generally vertical compressed stack of generally horizontal frames and membranes to an operating position wherein the frames and membranes are oriented generally vertically.

2. A method of assembling a monopolar filter press-type electrolytic cell having a plurality of generally planar electrodes appropriately mounted to electrode frames with ion-selective permeable membrane sheets interposed between each adjacent pair of electrodes, the assembly being accomplished at a single work area, which comprises the steps of:

(a) placing a first end frame on a generally horizontal supporting structure;
(b) conditioning the membrane sheets so that they are converted into their ionic conductive form and are equilibrated with the conditioning solution in which they are conditioned;
(c) placing a first cathode frame on top of said first end frame, said first cathode frame being oriented generally horizontally;
(d) placing a first of said membrane sheets on top of said generally horizontally oriented cathode frame, said first membrane sheet being oriented generally horizontally thereacross;
(e) placing a first anode frame on top of said first membrane sheet, said first anode frame being oriented generally horizontally;
(f) placing a second membrane sheet on top of said first anode frame, said second membrane sheet being oriented generally horizontally thereacross;
(g) placing a second cathode frame on top of said second membrane sheet, said second cathode frame being oriented generally horizontally thereon;
(h) repeating steps d-g a predetermined number of times until the desired number of anode and cathode frames are stacked in a generally vertical stack on top of the generally horizontal supporting structure;
(i) placing a second end frame on top of said generally vertical stack of frames;
(j) vertically compressing said generally vertical stack of frames by the application of uniform pressure to the first and second end frames so that substantially no horizontal movement of the electrode frames results as the frames are compressed together into a compressed state;
(k) securing retainers to said generally vertical stack of frames to retain said generally vertical stack of frames in said compressed state; and
(l) rotating said generally vertical compressed stack of generally horizontal frames and membranes to an operating position wherein the frames and membranes are oriented generally vertically.

3. The method of claim 1 wherein said membrane sheets are treated with a hydrolyzing fluid in an elevated membrane container adjacent a first side of said supporting structure by placing said membrane sheets in said hydrolyzing fluid and maintaining said membrane sheets in said hydrolyzing fluid until they are removed from said membrane container during said assembly method.

4. The method of claim 2 wherein said membrane sheets are treated with a conditioning fluid in an elevated membrane container adjacent a first side of said supporting structure by placing said membrane sheets in said conditioning fluid and maintaining said membrane sheets in said conditioning fluid until they are removed from said membrane during said assembly.

5. The method of claims 3 or 4 which further comprises the step of:

placing said electrode frames generally horizontally in an elevated frame container adjacent a second side of said supporting structure.

6. The method of claim 5 wherein said elevated frame container is a shelved cabinet and said frames are placed in said cabinet with one frame per shelf.

7. The method of claims 3 or 4 which further comprises the step of:

placing a spacer means between each anode frame and the membrane sheet on either side of said anode frame during said assembly method.

8. The method of claim 7 wherein said spacer means are prepositioned adjacent a third side of said supporting structure prior to said assembly method and said spacer means are slid onto said vertical stack during said assembly method.

9. The method of claim 7 wherein said spacer means are prepositioned adjacent a second side of said supporting structure prior to said assembly method and said spacer means are slid onto said vertical stack during said assembly method.

10. The method of claims 3 or 4 wherein the height of the bottom of said vertical stack is raised or lowered during said stacking operation so as to position the top of the stack at a better level for receiving frames and sheets from said frame and membrane containers.

11. The method of claim 9 wherein said height of said bottom is remotely adjusted from a position adjacent said elevated platform.

12. A method of assembling a monopolar filter press-type electrolytic cell having a plurality of generally planar electrodes appropriately mounted to electrode frames with ion-selective permeable membrane sheets interposed between each adjacent pair of electrodes, which comprises the steps of:

(a) placing a first end frame on a generally horizontal supporting structure;
(b) treating the membrane sheets with a hydrolyzing fluid;
(c) placing a first cathode frame on top of said first end frame, said first cathode frame being oriented generally horizontally;
(d) placing a first of said membrane sheets on top of said generally horizontally oriented cathode frames, said first membrane sheet being oriented generally horizontally there across;
(e) placing first spacer means on top of said first membrane sheet so that said first spacer means is in contact with at least a portion of said first membrane sheet;
(f) placing a first anode frame on top of said first membrane sheet, said first anode frame being oriented generally horizontally and spaced from said first membrane sheet by said spacer means;
(g) placing second spacer means on top of said first anode frame so that said second spacer means is in contact with at least a portion of said firt anode frame;
(h) placing a second membrane sheet on top of said first anode frame and said second spacer means, said second membrane sheet being oriented generally horizontally thereacross and spaced from said first anode frame by said spacer means;
(i) placing a second cathode frame on top of said second membrane sheet, said second cathode frame being oriented generally horizontally thereon;
(j) repeating steps d-i a predetermined number of times until the desired number of anode and cathode frames are stacked in a generally vertical stack atop the generally horizontally supporting structure;
(k) placing a second end frame on top of said generally vertical stack of frames;
(l) vertically compressing said generally vertical stack of frames into a compressed state;

(m) securing retainers to said generally vertical stack of frames to retain said generally vertical stack of frames in said compressed state; and (n) rotating said generally vertical compressed stack of generally horizontal frames and membranes to an operating position wherein the frames and membranes are oriented generally vertically.

13. A method of assembling a monopolar filter press-type electrolytic cell having a plurality of generally planar electrodes appropriately mounted to electrode frames with ion-selective permeable membrane sheets interposed between each adjacent pair of electrodes, which comprises the steps of:

(a) placing a first end frame on a generally horizontal supporting structure;

(b) conditioning the membrane sheets so that they are converted into their ionic conductive form and are equilibrated with the conditioning solution in which they are conditioned;

(c) placing a first cathode frame on top of said first end frame, said first cathode frame being oriented generally horizontally;

(d) placing a first of said membrane sheets on top of said generally horizontally oriented cathode frame, said first membrane sheet being oriented generally horizontally thereacross;

(e) placing first spacer means on top of said first membrane sheet so that said first spacer means is in contact with at least a portion of said first membrane sheet;

(f) placing a first anode frame on top of said first membrane sheet, said first anode frame being oriented generally horizontally and spaced from said first membrane sheet by said spacer means;

(g) placing second spacer means on top of said first anode frame so that said second spacer means is in contact with at least a portion of said first anode frame;

(h) placing a second membrane sheet on top of said first anode frame and said second spacer means, said second membrane sheet being oriented generally horizontally thereacross and spaced from said first anode frame by said spacer means;

(i) placing a second cathode frame on top of said second membrane sheet, said second cathode frame being oriented generally horizontally thereon;

(j) repeating steps d-i a predetermined number of times until the desired number of anode and cathode frames are stacked in a generally vertical stack atop the generally horizontal supporting structure;

(k) placing a second end frame on top of said generally vertical stack of frames;

(l) vertically compressing said generally vertical stack of frames into a compressed state;

(m) securing retainers to said generally vertical stack of frames to retain said generally vertical stack of frames in said compressed state; and (n) rotating said generally vertical compressed stack of generally horizontal frames and membranes to an operating position wherein the frames and membranes are oriented generally vertically.

14. The method of claim 12 wherein said membrane sheets are treated with a hydrolyzing fluid in an elevated membrane container adjacent a first side of said supporting structure by placing said membrane sheets in said hydrolyzing fluid and maintaining said membrane sheets in said hydrolyzing fluid until they are removed from said membrane container during said assembly method.

15. The method of claim 13 wherein said membrane sheets are treated with a conditoning fluid in an elevated membrane container adjacent a first side of said supporting structure by placing said membrane sheets in said conditioning fluid and maintaining said membrane sheets in said conditioning fluid until they are removed from said membrane during said assembly.

16. The method of claims 14 or 15 wherein said spacer means are prepositioned adjacent a third side of said supporting structure prior to said assembly method and said spacer means are slid into said vertical stack during said assembly method.

17. The method of claims 14 or 15 wherein said spacer means are prepositioned adjacent a second side of said supporting structure prior to said assembly method and said spacer means are slid onto said vertical stack during said assembly method.

18. A method of assembling a monopolar filter press-type of electrolytic cell having a predetermined number of electrode frames and a predetermined number of membrane sheets, the method comprising the steps of:

(a) treating the membranes with a hydrolyzing fluid at a work area;

(b) assembling the predetermined plurality of electrode frames in a generally vertical stack at the same work area, the frames being oriented generally horizontally with a treated generally horizontal membrane sheet interposed between each pair of opposing electrode frames;

(c) uniformly applying pressure to opposite vertical ends of said stack so that substantially no horizontal movement of the electrode frames results while said stack is vertically compressed;

(d) rotating said compressed vertical stack from a vertical orientation to a horizontal orientation;

(e) connecting said vertically assembled, rotated, horizontal stack into an electrical circuit and to raw material supply lines and product withdrawal lines; and (f) electrolytically operating said vertically assembled horizontal stack while maintaining said stack in said horizontal orientation.

19. A method of assembling a monopolar filter press-type of electrolytic cell having a predetermined number of electrode frames and a predetermined number of membrane sheets, the method comprising the steps of:

(a) conditioning the membrane sheets at a work area so that they are converted into their ion conductive form and are equilibrated with the conditioning solution in which they are conditioned;

(b) assembling the predetermined plurality of electrode frames in a generally vertical stack at the same work area, the frames being oriented generally horizontally with a conditioned generally horizontal membrane sheet interposed between each pair of opposing electrode frames;

(c) uniformly applying pressure to opposite vertical ends of said stack so that substantially no horizontal movement of the electrode frames results while said stack is vertically compressed;

(d) rotating said compressed vertical stack from a vertical orientation to a horizontal orientation;

(e) connecting said vertically assembled, rotated horizontal stack into an electrical circuit and to raw material supply lines and product withdrawal lines; and (f) electrolytically operating said vertically assembled horizontal stack while maintaining said stack in said horizontal orientation.

* * * * *